US005114214A

United States Patent [19]

Barman

[11] Patent Number: 5,114,214

[45] Date of Patent: May 19, 1992

[54] PROCESS FOR PRODUCING TOOTH BRUSHES AND BLANKS FOR USE FOR SAME

[76] Inventor: Rolf Barman, Olav Kyrregst. 45, N-5000 Bergen, Norway

[21] Appl. No.: 555,434

[22] PCT Filed: Dec. 13, 1988

[86] PCT No.: PCT/NO88/00091

§ 371 Date: Aug. 21, 1990

§ 102(e) Date: Aug. 21, 1990

[87] PCT Pub. No.: WO90/06701

PCT Pub. Date: Jun. 28, 1990

[51] Int. Cl.[5] ..... A46D 3/00; A46B 9/04

[52] U.S. Cl. ..... 300/21; 15/167.2; 15/172; 15/DIG. 5; 428/542.8

[58] Field of Search ..... 15/167.1, 167.2, 176.1, 15/172, 201, DIG. 5, DIG. 6; 300/21; 428/542.8

[56] References Cited

U.S. PATENT DOCUMENTS

| | | | |
|---|---|---|---|
| D. 273,153 | 3/1984 | Wagner | D4/28 |
| 1,901,646 | 3/1933 | Hicks | 15/167.1 |
| 1,928,328 | 9/1933 | Carpentier | 15/172 |
| 1,967,783 | 7/1934 | Rudof | 15/167.2 |
| 2,244,615 | 6/1941 | Garcin | 15/167.2 |
| 2,701,380 | 2/1955 | Ripper | 15/167.2 |
| 2,807,820 | 10/1957 | Dinhofer | 15/176.1 |
| 3,263,258 | 8/1966 | Burge | 15/167.1 |
| 4,449,266 | 5/1984 | Northemann et al. | 300/21 |
| 4,757,570 | 7/1988 | Haeusser et al. | 15/167.2 |

FOREIGN PATENT DOCUMENTS

| | | | |
|---|---|---|---|
| 1419 | of 1927 | Australia | 15/167.2 |
| 150436 | 8/1937 | Austria | 15/167.2 |
| 640683 | 12/1963 | Belgium | 15/167.2 |
| 660830 | 6/1938 | Fed. Rep. of Germany | 15/172 |
| 1075171 | 10/1954 | France | 15/167.1 |
| 350456 | 9/1937 | Italy | 15/167.2 |
| 179403 | 11/1935 | Switzerland | 15/167.2 |
| 426079 | 3/1935 | United Kingdom | 15/167.2 |

*Primary Examiner*—Philip R. Coe
*Assistant Examiner*—Mark Spisich
*Attorney, Agent, or Firm*—Francis C. Hand

[57] ABSTRACT

A process for producing a toothbrush produced thereby have the cavities (11, 12) arranged on the back side of the tooth brush head. The longitudinal axes (14*a*, 15*a*) for angling the head portions (13, 14, 15) relative to each other are arranged on or at the bristle-carrying side of the head portion directly opposite the associated cavity (11, 12). A blank for carrying out the process and a toothbrush produced thereby have the cavities (11, 12) arranged on the back side of the toothbrush head. The longitudinal axes (14*a*, 15*a*) for angling the head portions (13, 14, 15) relative to each other are arranged on or at the bristle-carrying side of the head portion directly opposite the associated cavity (11, 12).

14 Claims, 3 Drawing Sheets

FIG. 1
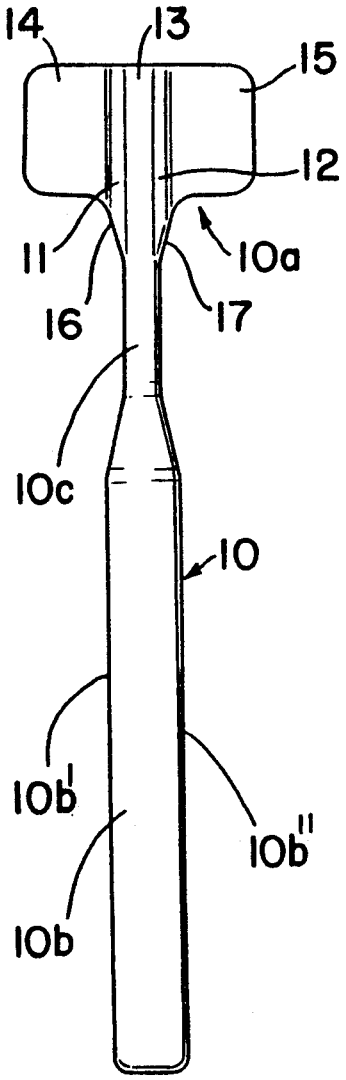
FIG. 2
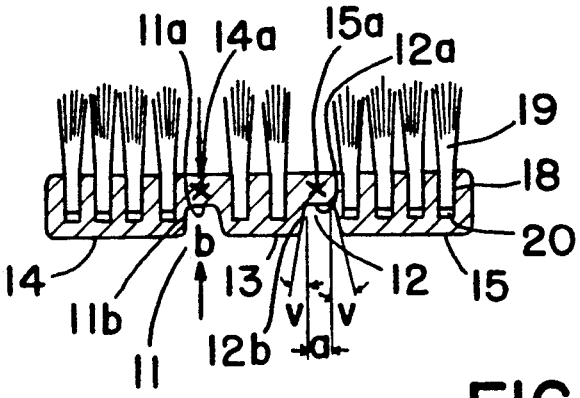
FIG. 4
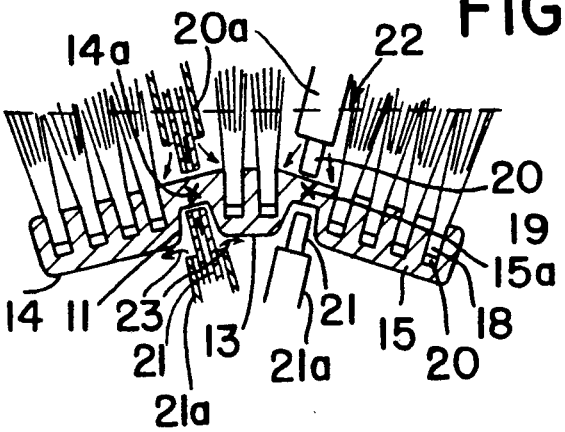
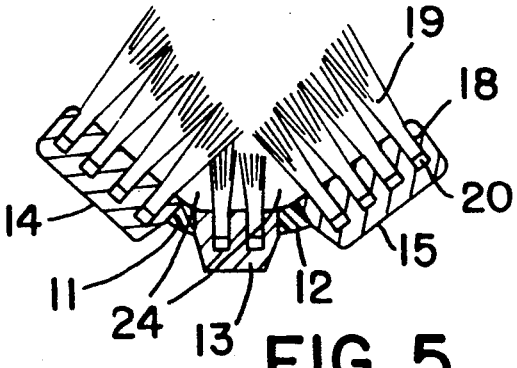
FIG. 5
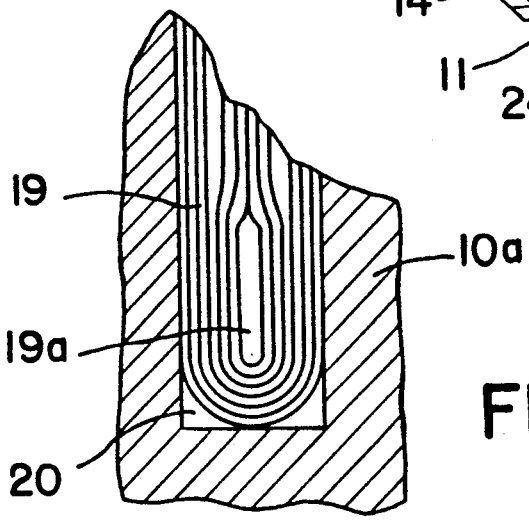
FIG. 3

PROCESS FOR PRODUCING TOOTH BRUSHES AND BLANKS FOR USE FOR SAME

With the present invention the particular aim is to be able to produce a toothbrush which is provided with groups of bristles arrnged so that these can produce effective cleaning of the surfaces of the tooth and adjacent gum portions including the depressions or the passages between the tooth surfaces and the gum portions together with the intermediate spaced between the teeth.

First and foremost, the aim is a process with which the production can be carried out as far as possible in a wholly automatised manner. In this connection, the objective is a process with which a tooth brush can be produced which a) is effective in use and for one thing has a design which is compact and takes little space at the same time as it provides good brushing effects, and which b) can be made in an accurate and reliable manner, with a favourable positioning of the groups of bristles relative to each other and, which c) can be designed so that the least possible collection of food residues, tooth paste residues, and the like results at the root of the groups of bristles.

According to the invention, a particular objective is a tooth brush having three head portions, that is to say a middle head portion and two lateral head portions which are arranged each on its respective side of the middle head portion and which are separated from the middle head portion by means of an intermediate passage portion with a cavity or attenuation groove.

Alternatively, tooth brushes can be designed with for example four, five or six separate head portions arranged in an angled or arcuate cross-sectional profile The present invention is of particular interest in connection with the production of a tooth brush, such as disclosed in NO Patent Application 880072 and U.S. Pat. Nos. 4,876,157 and 4,938,539, but is not limited to such a mode of production. In said patent application there is disclosed a tooth brush construction where the second and third head portion are to be subjected, after the mounting of the groups of bristles in the different head portions, to a first bending with a negative angle of curvature and thereafter to a second bending with a positive angle of curvature. The first bending with a negative angle of curvature is employed in order to be able to cut the size and finally treat (polish) the groups of bristles to established, locally defined bristle lengths with a single finishing equipment. The second bending with a positive angle of curvature is employed in order to be able to fashion the head portions with their final angled contours relative to each other, where it is decisive that the groups of bristles converge towards each other in the manner precisely intended.

After the groups of bristles are placed in position in for example a first, second and third head portion—while these head portions are flush with each other in the starting position—there is relatively limited space for the heating equipment arranged between the groups of bristles. With a negative bending of the head portions such as disclosed in NO Patent Application 880072, there is provided a better space between the groups of bristles for the heating equipment prior to a positive bending of the head portions, that is to say prior to a bending in an opposite direction to the negative bending effected by way of introduction.

With the hitherto proposed solutions, the cavities and the attenuation grooves between the head portions on the bristle-carrying side of the head are designed, so that with the subsequent positive bending to the final form the bending has been able to be effected at the same time as the cavities become compressed, that is to say at the same time as the head portions on the bristle-carrying side are pushed tightly together towards each other.

A problem with the last-mentioned solution is however that in the tightly pushed together grooves on the bristle-carrying side of the head portion there is a tendency for pockets to be formed for the collection of food residues, tooth paste and the like.

With the present invention the aim is a solution where the head portions can be arranged in such a manner that one is not dependent upon a subsequent pushing together of the head portions, but nevertheless obtains relatively tightly abutting head portions on bristle-carrying sides of the head, without collecting depressions for food residues and the like and simultaneously the abundant possibility of access for the heating equipment independently of the groups of bristles of the head.

In practice it has proved difficult to be able to carry out the manufacture of a tooth brush according to NO Patent Application 880072 with automatically operating production equipment Particular problems can arise in connection with the heating sequence just before and during the angling sequence The problems arise mainly as a consequence of the limited space at one's disposal in order to achieve effective heating of the angling region of the head of the tooth brush, while adjacent regions are to be spared as far as possible from such heating.

According to the known solution, one has chosen to place the cavities or the attenuation grooves between the head portions on the bristle-carrying side of the head of the tooth brush in order to obtain the best possible space for the heating equipment. By effecting the heating in said cavity or attenuation groove and thereafter carrying out the bending to the final form, the V-shaped cavities can be clamped together at the same time into I-shaped slits and if necessary the surface of the cavities melted together into continuous contact But this is difficult to manage in a wholly automatic manufacturing process.

According to the known construction it can be crowded for space for the heating equipment in the introductory heating, while the introductory, negative bending however will result in an opening of the V shape, so that better access is provided for the heating equipment from the bristle-carrying side of the head of the tooth brush to the cavities or the attenuation grooves in the subsequent heating operation, prior to the finishing, positive bending of the head portions.

With the present invention the aim is to achieve a better possibility of access for the heating equipment to the bottom of the cavities or the attenuation grooves generally, that is to say both before a first negative bending and before a subsequent positive bending of the head portions, without complicating thereby the design of the tooth brush head. Furthermore the aim is to be able to design the cavities or the attenuation grooves so that the heating can be restricted to the greatly limited regions of the tooth brush head, that is to say mainly to the passage portions between the head portions By this there can be achieved a more rapid heating and a better controlled heating and thereby an increased possibility for rational manufacture of the tooth brush in a more or less wholly automatic production.

In the known constructions, with attenuation grooves or cavities on the bristle-carrying side of the head of the tooth brush, there is obtained the disadvantage that the groups of bristles which are localised tightly up to the cavities or the attenuation grooves, have a tendency to loosen from their fastening in the tooth brush head as a consequence of the deformation of the fastening holes of the groups of bristles produced by an undesired heating of the fastening regions or the groups of bristles. With the present invention the aim is to avoid this disadvantage.

The process according to the invention is characterised in that the cavities or the attenuation grooves are fashioned on the back side of the head of the tooth brush, that is to say on the side opposite the bristle-carrying side, and that the tooth brush head is subjected to a local heating at the bottom of each of the cavities or the attenuation grooves in that there is introduced in each cavity or attenuation groove a heat-conducting means for heating the cavity or the attenuation groove at the bottom of same, after which the angling is effected about a respective one of said axes, which is arranged on or at the bristle-carrying side of the tooth brush head, just at the bottom of the associated attenuation groove.

If high frequency heating is used, electrical conductors can be arranged simultaneously on opposite sides of the tooth brush head and effective heating of the intermediate portion at the bottom of the cavities or the attenuation grooves can be effected, without affecting adjacent groups of bristles or their fastening points. With such high frequency heating a spontaneous heating can be obtained as a consequence of the dielectric in the material right through the material in the intermediate portion.

If hot air heating is used, it is preferred that the heating is effected largely only or if desired in its totality from the back side of the tooth brush head and then as tightly as possible upwardly towards the bottom of the cavities or the attenuation grooves. In such a case, it is preferred that the wall thickness between the head portions, that is to say the wall thickness in the cavities is the least possible in order to obtain rapid through-heating of this wall portion. By employing a relatively thin-walled layer in the regions between the head portions, an especially rapid and effective heating can be obtained and a correspondingly precise limiting of the heating to said regions between the head portions.

The present invention also relates to a blank for producing a tooth brush according to the afore-mentioned process, including a tooth brush head with at least three head portions, which are separated in pairs from each other by means of an intermediate cavity or attenuation groove, the head portions being adapted to be angled relative to each other about an axis parallel to an associated cavity or attenuation groove after associated groups of bristles are fastened in place and after a local heating of the tooth brush head is effected in the regions between the individual head portions.

The blank according to the invention is characterised in that the cavities or the attenuation grooves are fashioned on the back side of the tooth brush head, that is to say on the opposite side of the bristle-carrying side, and that the axes for angling of the head portions relative to each other, are arranged on or at the bristle-carrying side of the head portion, directly opposite the associated cavity or attenuation groove.

By placing the cavities or the attenuation grooves on the side opposite the bristle-carrying side, several significant advantages are achieved. A first material advantage consists in the cavities or the attenuation grooves being able to be employed as effective guide grooves for leading the blank from finishing station to finishing station Another important advantage consists in the heating operation (especially by hot air heating) being able to be effected in its totality or for the most part from the side of the tooth brush head which lies opposite the bristle-carrying side. By this, the heating arrangement can be effectively introduced in the associated cavity or attenuation groove in order to ensure a concentrated and locally limited heating of the passage portions between the head portions in the tooth brush head and a corresponding accurate positioning of the heating arrangement in the attenuation groove, without risking unintended heating of the groups of bristles in the adjacent head portions.

According to the invention bending of the head portions can be obtained relative to each other precisely in the intended manner, by a concentrated bending in the passage portion between two neighbouring head portions. As a consequence of the accurate bending achieved, the neighbouring head portions can be fashioned relative to each other, so that certain of the groups of bristles in the outer head portions can be arranged flush with or in between the groups of bristles in an intermediate head portion. One can ensure thereby that the groups of bristles in neighbouring head portions can effectively support and brace each other at outer ends of certain groups of bristles, while remaining groups of brushes in the outer head portions are uncovered outside the intermediate head portion, without such extra bracing and extra support. Consequently, there can be ensured in a ready manner different brushing effects for the groups of brushes of different head portions.

The present invention also relates to a tooth brush which includes a tooth brush head with at least three head portions which are separated from each other in pairs by means of an intermediate cavity or attenuation groove and which are angled relative to each other about an axis parallel to an associated cavity or attenuation groove, rows of bristle groups being fastened to respective head portions, with the groups, of bristles in the one outer head portion obliquely disposed towards the groups of bristles in the other outer head portion, where the groups of bristles have increasing bristle lengths reckoned laterally from the middle portion of the tooth brush head outwardly towards opposite longitudinal side edges of the tooth brush head and where certain bristle groups have bristles with larger bristle diameters than the bristles in remaining bristle groups.

By the expression "bristle group" is to be understood herein a bunch or bundle of synthetically produced filaments formed with certain established lengths. The expression "bristle group" does not exclude other materials, such as pig bristles, horse hairs or other natural products, but as a consequence of a lacking supply of such natural products these usually get little application. By the expression "bristle group" is to be understood besides such a small bunch or bundle as there is space for in each associated hole in the tooth brush head. When one refers herein to the groups of bristles being arranged in "rows" this alludes to the groups of bristles being arranged accurately in rows. However it will be readily realised that the groups of brushes can be arranged in different ways that is to say more or less irregularly, for example in a changing zig-zag path or in a similar manner.

With the present invention the aim as mentioned is to achieve a best possible brushing effect for the tooth crown portion, the tooth sides, the intermediate spaces of the tooth and the depressions or the pockets between tooth and gum with one and the same tooth brush by a simple and uncomplicated movement of the tooth brush relative to a row of teeth in the mouth of the user. Furthermore, the aim is a design of the tooth brush head as favourable as possible both as to handling, strength and hygiene.

The tooth brush according to the invention is characterised in that the cavities or the attenuation grooves are arranged on the side opposite the bristle-carrying side of the tooth brush head, and that the groups of bristles in the middle head portion are terminated approximately level with the groups of bristles in the innermost rows of bristle groups of the two outer head portions.

An especially favorable solution consists in the groups of bristles with the largest bristle diameter which in a manner known per se are mainly limited to the middle portion of the tooth brush head—being arranged at least in certain of the groups of brushes in the innermost row or innermost rows of bristle groups of the two outer head portions, the innermost row of bristle groups of the two outer head portions obliquely colliding mutually or towards intermediately disposed bristle group(s) in an intermediately disposed head portion.

A further advantageous solution consists in the passage portions between the head portions being graduated with a relatively shallow cavity or attenuation groove on the bristle-carrying side of the tooth brush head and an appreciably deeper cavity or attenuation groove on the opposite side of the tooth brush head. By this one can nevertheless achieve with a restricted consumption of material great rigidity and strength on different head portions of the tooth brush head relative to each other and relative to the handle portion of the tooth brush.

Further features of the invention will be evident from the following description having regard to the accompanying drawings, in which:

FIG. 1 shows a plan representation of a tooth brush blank seen from the back side of the blank.

FIG. 2 shows a cross-section of the head of the tooth brush blank after groups of bristles are set in position in the same.

FIG. 3 shows a detail of FIG. 2 on a larger scale.

FIG. 4 shows in a corresponding section to FIG. 2, said head after a first bending with a negative bending angle is effected.

FIG. 5 shows in a corresponding section to FIG. 4 the head of the tooth brush after a bending with a positive angle is effected.

Figure 6:
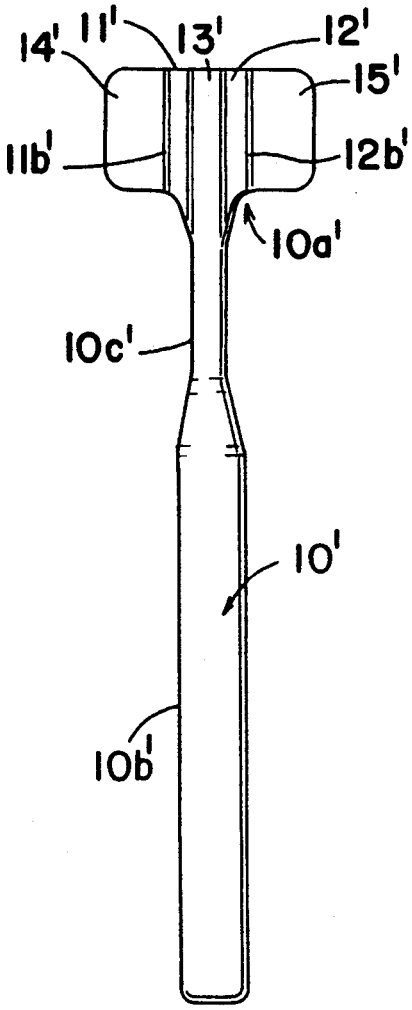
FIG. 6 shows in a representation corresponding to that shown in FIG. 2 the tooth brush in a finally formed condition with associated considerable enlargement of the grooves at the bottom of these.

In FIG. 1 there is shown a tooth brush blank 10 with a head 10*a* and a handle 10*b* together with a narrowed neck 10*c*. On the back side of the tooth brush blank 10, as shown in FIG. 1, there are fashioned cavities or attenuation grooves 11 and 12 which extend in the longitudinal direction of the tooth brush, that is to say parallel to the illustrated rectilinear sides 10*b*' and 10*b*'' of the handle. The cavities of the attenuation grooves 11 and 12 partition the head 10*a* into three rectangular head portions 13, 14 and 15.

A first, middle head portion 13 extends essentially flush with and parallel to the neck 10*c* between the head 10*a* and the handle 10*b*. A second head portion 14 projects laterally outwards from the one groove 11, while the other head portion 15 projects laterally outwards from the second groove 12. On each side of the neck 10*c*, that is to say in the transition portion between the head portion 14 and the neck 10*c*, and in the transition portion between the head portion 15 and the neck 10*c* there extend rounded corner bracing portions 16 and 17, which are flush with the associated cavity or attenuation groove and which have minimal wall thickness, that is to say a wall thickness corresponding to the wall thickness of the cavities or attenuation grooves.

As shown in the starting position of the blank in FIG. 2 the head portions 13, 14 and 15 are flush with each other. In each head portion 13, 14, 15 there are designed a number of holes 18, which are arranged in a number of longitudinal and transverse rows. In FIG. 2 there is shown only one transverse row of holes. More specifically there is shown a row of two holes in the first head portion 13 and a row of four holes in each of the two remaining head portions 14 and 15. The number of rows and the number of holes in each row is not critical and can be changed according to desire and need, but it is assumed that one or two holes are present in each row in the head portion 13, all according to whether a relatively small or a relatively large tooth brush is under discussion.

In each hole 18 there is inserted a group of bristles 19. Each bristle group 19 is, as is shown in FIG. 3, fastened in place in an associated hole 18 with a fixing disc 20. The bristle group 19 is pushed in together with the fastening disc in a manner known per se and secured in the hole 18 by means of friction. As illustrated the inner end 19*a* of the bristle group is localised with the associated fastening disc 20 in the bottom of the hole 18. As shown in FIG. 2, the bottoms 11*a*, 12*a* of the cavities or the attenuation grooves 11, 12 are arranged at a level considerably above the level for the fastening disc 20 of the bristle group. The cavities or the attenuation grooves 11, 12 have a breadth a at the bottom 11*a*, 12*a* which substantially corresponds to the height b of the cavities or the attenuation grooves or of side surfaces 11*b*, 12*b* of these. The side surfaces 11*b*, 12*b* converge outwardly from the respective bottom 11*a* and 12*a* separately at an angle v of about 15°.

In FIG. 1 and 2 the attenuation grooves are shown with a maximum breadth a' which corresponds for example to the minimum breadth a plus 1 mm, while the attenuation grooves in FIG. 5 and 6 are illustrated with a maximum breadth a" which corresponds for example to the minimum breadth a plus 3 mm. Instead of getting a compressed attenuation groove in the finally fashioned condition of the tooth brush head, according to the known solutions with the attenuation grooves on the bristle-carrying side, there is obtained, as a consequence of a certain stretching action in the material of the cavities or the attenuation grooves during the bending operation which follows the heating operation, a somewhat expanded connecting portion between the head portions not only on the back side of the tooth brush head but also on the bristle-carrying side of the tooth brush head.

According to the invention the tooth brush head can be designed to develop relatively uniformly and without material gradations on the bristle-carrying side of the tooth brush head and can thereby avoid to a large extent the collection of food residues, tooth paste residues and the like, in the finally formed tooth brush head.

In the illustrated embodiment the head 10*a* has in the starting position (FIG. 1 and 2) a collected breadth of about 34 mm and a length (reckoned parallel to the handle 10*b* ) of 20 mm. The head portions 13, 14, 15 have a thickness of 5 mm. The head portion 13 has a breadth of 6 mm, while the head portions 14 and 15 each have a breadth of 12 mm. Holes 18 of the head portions 13, 14, 15 for the bristle groups have a depth of about 3.7 mm. The depth of each attenuation groove is of about 2.5–3.5 mm, while the breadth a of each attenuation grooves is of about 2 mm.

In FIG. 4 the head 10*a* is shown after a heating of this is effected on its bristle-carrying side by means of a first type of hot air nozzle 20, while a second type of hot air nozzle 21 is received at the bottom of the attenuation grooves 11, 12 on the opposite side of the tooth brush head. In FIG. 4 head portions 14 and 15 of the head 10 are shown bent over with a negative bending angle relative, to the head portion 13 after a first heating of the regions in the cavities or the attenuation grooves 11, 12 is effected. By a broken line 22 in FIG. 4 there is indicated a section line for cutting collected groups 19 of bristles in one and the same operation to established rows of different lengths, with the head in a negatively tent condition.

In FIG. 5 the head 10*a* is shown after it is heated anew, in a manner corresponding to that described above, by means of the hot air nozzles 10 and 21. The head 10*a* is shown in FIG. 5 bent over with a positive bending angle to the finally produced shape of the tooth brush.

In FIG. 6 there is shown the finally produced tooth brush 10' with the associated tooth brush head 10*a'* in finally fashioned condition, that is to say after the head portions 14 and 15 are bent with said positive bending angle as shown in FIG. 5, and after the hot air nozzles 20 and 21 are removed from the tooth brush. In the present embodiment hot air nozzles are employed as heat conducting means 10 and 21 for heating the respective bottoms 11*a* and 12*a* of the attenuation grooves 11, 12 with a stream of hot air.

Alternatively there can be employed other types of suitable heat conducting means, such as high frequency heat conducting means. By means of such high frequency heat conducting means direct dielectric contact can be formed with heat conducting means on opposite sides of the tooth brush head, that is to say directly opposite the cavities or the attenuation grooves. In such an instance there is no need for special screening of the heating means, an effective local heating being achieved with the electrodes only in the material in the bottom of the cavity or the attenuation groove.

In the illustrated embodiment the hot air nozzles 20, 21 are limited by heat insulating conducting means 20*a* and 21*a* which are to prevent unintended heating of the groups of bristles and side surfaces 11*b* and 12*b* of the attenuation grooves. The conducting means can for example be swept externally with cool air, as is indicated by arrows 23. By means of the hot air nozzles 20, 21 and the heat insulating conducting means 20*a*, 21*a* there can be ensured a controlled, local heating of the passage portions between the head portions 13 and 14 and between the head portions 13 and 15, while the head portions 13, 14, 15 at side surfaces 11*b*, 12*b* of the attenuation grooves are kept moderately heated. By this unintended deformation of the head portions 13, 14, 15 can be prevented at the same time as the accurate bending over of the head portions in the intended manner can be ensured relative to each other.

In order to prevent the groups of bristles from being loosened from the respective holes, it is of critical importance that heating of side surfaces 11*b* and 12*b* of the cavities or the attenuation grooves is prevented and thereby heating of the head portions 13, 14, 15 is reduced or prevented, at any rate at the bottom of the holes 18, where each bristle group is fastened with its respective metal disc. By means of crosses 14*a* and 15*b* there are indicated the bending axes for the head portions 14 and 15 respectively. In order to obtain a favourable placing of the innermost longitudinal row of bristle groups 19 in the head portions 14 and 15 relative to adjacent bristle groups in the head portion 13, it is of importance that the bending axis is placed in a region near the cavity or the attenuation groove and more specifically in a region which lies furthest from the head portion 13.

In FIG. 4 there is illustrated a moderately negative bending angle. In order to obtain greater differences in the lengths of bristles internally in the different head portions 14 and 15 and relatively to the bristle length in the head portion 13 there can be employed a larger negative bending angle than shown in FIG. 4.

In FIG. 5 there is also shown a moderately positive bending angle. In order that the groups of bristles in the head portions 14 and 15 shall reach further round to each other there can be employed a larger positive bending angle than shown in FIG. 5.

According to an alternative mode of manufacture the blank in the initial condition can, instead of the design which is shown in FIG. 2, be made for example with a negative bending angle as shown in FIG. 4, the groups of brushes can then be filled directly into the head portion in the position which is shown in FIG. 4. Thereafter, cutting of the groups of brushes is effected, as is shown by the rectilinear broken line 22 in FIG. 4. It will also be possible, instead of effecting the bending with a negative bending angle as shown in FIG. 4, to carry out cutting directly in a starting position as shown in FIG. 2 by employing suitable finishing equipment for this which forms a directly fashioned, concave countersinking along the top of the groups of brushes.

Instead of effecting heating from opposite sides of the tooth brush head by means of hot air nozzles 20, 21 the heating can if desired be effected prior to the bending with a negative bending angle only by means of the hot air nozzles 20, while in a subsequent heating step for bending the tooth brush head with a positive bending angle there can be employed only the hot air nozzles 21. As shown in FIG. 5, the heating in the bottom of the attenuation grooves can be limited to restricted regions, as is shown by hatched edge portions. By this it can be ensured that the bottom of the cavities or attenuation grooves is heated to an especially strong degree, and that it is extended during the bending operation to a positive bending angle mainly to layers of the passage portions between the head portions 13 and 14 and 13 and 15 adjacent the bottom.

Figure 7:
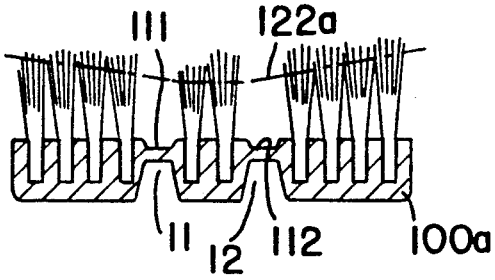
FIG. 7 and 8 show a second embodiment illustrated in a section corresponding to FIG. 2 and FIG. 5.
Figure 8:
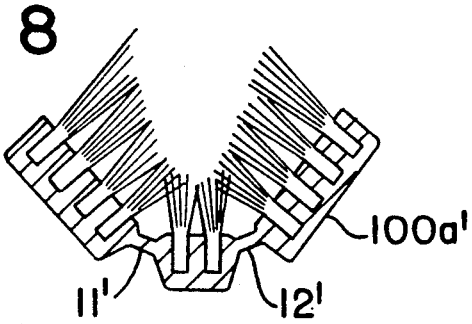

In FIG. 7 and 8 there is illustrated a second embodiment. In FIG. 7 there is shown a tooth brush blank 100 with a head 100*a* having an arcuate section line 122*a* produced by means of suitable finishing equipment from a starting position as shown correspondingly in FIG. 2. In FIG. 8 there is shown the finished design of the finally flexed tooth brush head 100' in a section corresponding to FIG. 5. In the embodiment according to FIG. 7 and 8 there are produced relatively deep cavities or attenuation grooves 11, 12 on the back side of the head of the tooth brush and oppositely disposed, relatively shallow cavities or attenuation grooves 111, 112 on the bristle-carrying side of the tooth brush head. As is shown in FIG. 8 an especially thin-walled passage portion is obtained between each pair of head portions 13, 14 and 13, 15.

Figure 9:
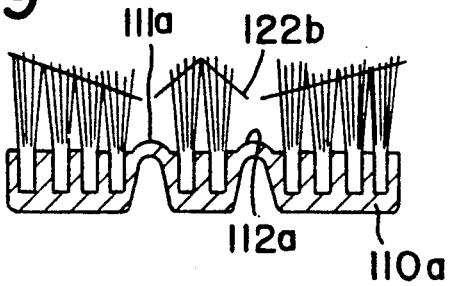
FIG. 9 and 10 show a third embodiment illustrated in a section corresponding to FIG. 2 and FIG. 5.
Figure 10:
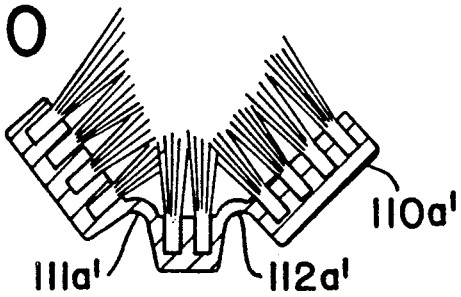

In FIG. 9 there is shown a third embodiment of a tooth brush head 110*a* having a concavely and convexly folded section line 122*b*, produced in a starting position as shown correspondingly in FIG. 2. In FIG. 10 there is shown a design following from this of the finally flexed tooth brush head 110*a'*, shown in a section corresponding to that shown in FIG. 5. According to FIG. 9 the bristle groups in the middle head portion 13 are fashioned substantially longer than the adjacent groups of bristles in the neighbouring head portions 14 and 15. By this the relatively longer and thereby somewhat softer or less rigid bristles in the head portion 13 are supported in an effective manner in a wedge engagement between the groups of bristles in the neighbouring head portions 14 and 15. As shown in FIG. 10 certain bristles in the bristle groups in the head portions 14 and 15 are threaded locally inwardly between the bristles of the bristle groups in the middle head portion 13 for extra support and closing off of the bristle groups of the middle head portion.

In the construction according to FIG. 9 and 10 there are shown especially deep cavities or attenuation grooves 11, 12 on the back side of the tooth brush head and instead of cavities or attenuation grooves on the bristle-carrying side of the tooth brush head there are shown convexly arched beads 11*a*, 112*a* together with a thin-walled passage portion between the head portions 13, 14 and 13, 15 respectively.

Figure 12:
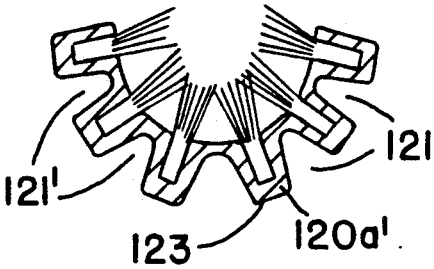
FIG. 11 and 12 show a fourth embodiment illustrated in a section corresponding to FIG. 2 and FIG. 5.
Figure 11:
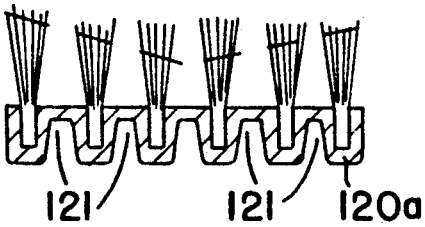

In FIG. 11 and 12, there is shown a fourth construction of a tooth brush head 120*a*, which is illustrated with five cavities or attenuation grooves 121 which correspondingly define six separate head portions 123. In the illustrated embodiment there is illustrated only one bristle group row in each head portion, but the number of bristle group rows in each head portion can be varied and if desired increased to two or more, according to need. Further, the bristles are cut in order to effect a decreasing height in a direction centrally of the blank.

Even if it is preferred to use thermoplastic materials with large shape durability on heating up to or above 100° for producing quality tooth brushes according to the invention, thermoplastic materials can also be used according to the invention which permit flexing with a minimal supply of heat energy. Thermoplastic shaping can then be achieved at a temperature of for example substantially below 100° and down towards room temperature, by employing material which tolerates bending on the application of sufficient force and which ensures that the tooth brush head retains the flexed shape wholly or partly after bending, if desired combined with after hardening.

Figure 13:
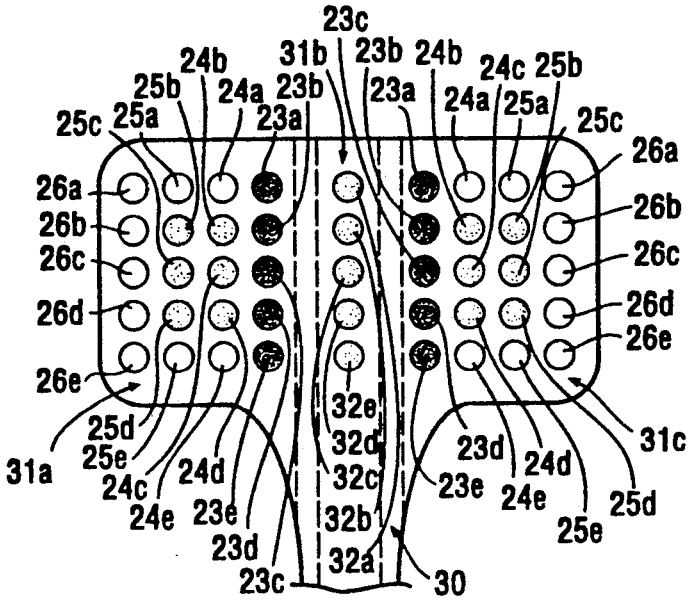
FIG. 13 shows in part a plan representation of a tooth brush head according to the invention.

In FIG. 13 there is shown a tooth brush blank 30 with a tripartite head 31, that is to say with three mutually angled head portions 31*a*, 31*b*, 31*c* connected in pairs. The two outer head portions 31*a* and 31*c* are shown substantially rectangular with a rectangular distribution of groups of bristles 23*a*–23*e*, 24*a*–24*e*, 25*a*–25*e* and 26*a*–26*e*. In the middle head portion 31*b*, which is also rectangular, there is shown a single row of bristle groups 32*a*–32*e*, but in practice there can be employed for example two (or more) rows of bristle groups in the middle head portion. According to FIG. 13 all the groups of bristles are shown in rows longitudinally as well as sideways in the tooth brush head.

Figure 14:
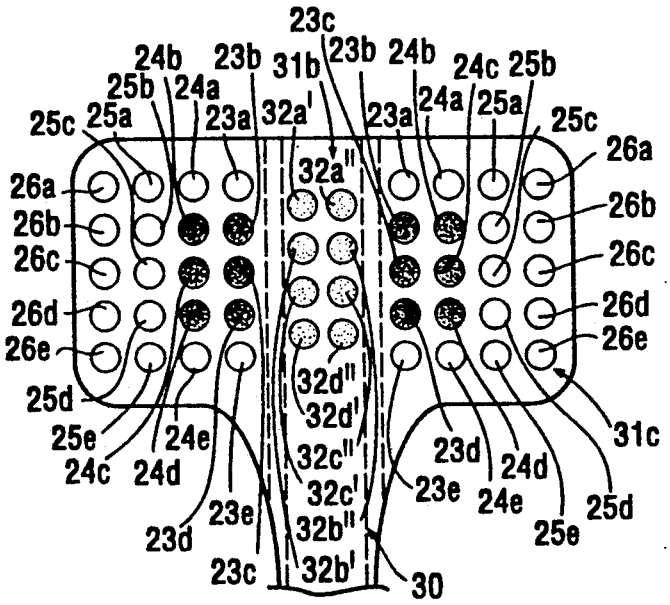
FIG. 14 shows in a representation corresponding to FIG. 13 an alternative construction of tooth brush head according to the invention.

In FIG. 14 there are shown in a representation corresponding to FIG. 13 two rows of bristle groups 32*a*'–32*d'* and 32''–32*d*'' which extend mutually in rows longitudinally as well as sideways in the tooth brush head, but which in the lateral direction of the tooth brush head extend out of alignment with the rows of bristle groups in the neighbouring head portions 31*a* and 31*c*. By this each bristle group in the middle head portion 31*b* can be threaded in between and supported by two neighbouring bristle groups in a respective neighbouring head portion 31*a* and 31*c*.

In the embodiments in FIG. 13 and in FIG. 14 there are shown a tooth brush blank with associated bristle groups which have bristles (filaments) of different rigidity. There is illustrated a section of a tooth brush head with the blank illustrated in plan condition. After mounting associated bristle groups the tooth brush head is bent first with a negative angle and thereafter the groups of bristles are all cut in this negative angle position, in order thereafter to bend the head portions to the finally angled form.

According to FIG. 13 there are illustrated in the head portions 31*a* and 31*c* inner bristle groups 23*a*, 23*b*, 23*c*, 23*d*, 23*e* (shown totally black) of a first type with relatively maximum rigidity and bristle groups 24*c*, 25*c*, 26 (shown spotted) of a second type having medium rigidity together with remaining bristle groups 24*a*, 26*a*; 24*b*, 26*b*; 24*d*, 25*d*, 26*d* and 24*e*, 25*e*, 26*e* (shown totally white) of a third type with minimum rigidity In the head portion 31*b* there are shown bristle groups 32*a*–32*e* (shown spotted) of a second type having medium rigidity.

According to FIG. 14 there are shown in the head portions 31*a* and 31*c* two inner rows of bristle groups 23*b*–23*d* and 24*b*–24*d* (shown totally black) of the first type having relatively maximum ridigity and remaining bristle groups, including bristle groups 32*a*'--32*d*', 32*a*'-'--32*d*'' (shown white) of the head portion 31*b* of the third type having relatively minimum rigidity.

In an assortment of "bristles" or filaments of interest according to the invention there can be employed for example the following five assortments each with its specific, bristle diameter, namely; A) 0.10 mm, B) 0.15 mm, C) 0.20 mm, D) 0.25 mm and E) 0.30 mm. Of these the assortment D represents a first type of relatively rigid "bristle", while the assortment C represents a second type of more medium rigidity and the assortment B represents a third type having little rigidity or great softness The assortment A can for example be employed in admixture together with the assortment B in order to achieve especially soft and slightly rigid "bristles" in bristle groups of the third type, while correspondingly the assortment E can be employed in admixture with the assortment D in order to achieve an especially rigid "bristle" in bristle groups of the first type. All according to need however different mixtures of the assortments A-E can be chosen for the different types of bristle groups.

The first type of bristle groups can for example consist exclusively of rigid bristles that is to say bristles having a relatively large bristle diameter or of a predominant quantity of bristles of relatively large bust diameter and a smaller quantity of bristles of less rigidity (greater softness).

The second type of bristle groups can for example consist of substantially half bristles of great rigidity and the remaining half of bristles of small or more medium bust diameters.

The third type of bristle groups can for example consist of a predominant quantity of bristles of small bristle diameter and a smaller quantity of bristles of somewhat larger bristle diameter. Alternatively the third type of bristle groups can consist only of bristles having small bristle diameters.

By this the different bristle groups can be allowed to exert different brushing effects all according to the rigidity of the bristle group and all according to the locating of the bristle group in the tooth brush head.

According to the invention certain bristle groups can be allowed to provide extra supporting effect to neighbouring groups, while correspondingly certain bristles in the different bristle groups can be allowed to exert a certain supporting effect for neighbouring bristles in the bristle group in question.

Figure 15:
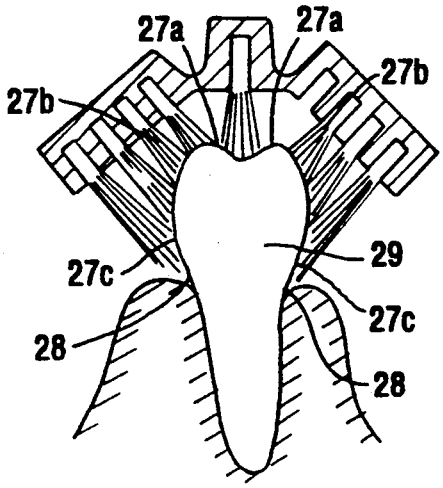
FIG. 15 shows a tooth brush according to the invention schematically represented during brushing of a tooth.

In FIG. 15 it is made clear how some groups of bristles of the first and second type of bristle groups form support abutments sideways and endways against adjacent tooth surfaces 27*a*, 27*b*, while bristles in the third type of bristle groups can extend along adjacent tooth surfaces 27*c* and can effectively reach into a gum pocket 28 and into a tooth intermediate space 29.

Tooth brushes of the afore-mentioned kind are advantageous in that certain bristle groups can brush the teeth and especially tooth crowns of the molars (chewing surfaces with depressions and grooves) at the same time that remaining bristle groups can brush flanks (inner side and outer side) of teeth with tooth necks and in gum pockets in the transition between tooth and gum, by movement of the tooth brush longitudinally along the row of teeth. By means of a moderate rotation of the head of the tooth brush about the longitudinal direction of the tooth brush or the longitudinal axis of the tooth brush head outwardly facing and inwardly facing tooth flanks of the teeth can be brushed one after the other, at the same time that tooth crowns of the teeth with chewing surfaces are brushed with bristle groups at a different oblique position.

In order to obtain an effective, but at the same time gentle brushing of the gum pockets between the gum and the teeth and an effective brushing of the intermediate spaces between the teeth, it is of considerable importance that the bristles have suitable rigidity and suitable softness in different regions of the tooth brush head. It has not been possible hitherto to adapt the rigidity and the softness of the bristles in a satisfactory manner in one and the same construction, at the same time that the different bristle groups acquire a favourable contour relative to the different tooth sections, the gum and tooth intermediate spaces.

With usual tooth brushes having a planar tooth brush head and having an approximately uniform bristle end plane one has hitherto employed a type of bristle groups of rigid bristles in the middle portion of the tooth brush head and a type of bristle groups of soft bristles in the peripheral portion of the tooth brush head. With this type of tooth brush effective brushing of projecting edges of the teeth and relatively large surfaces of the teeth can be achieved as a consequence of the use of relatively rigid bristles in the middle portion of the tooth brush head. At the same time the aim is to obtain a more gentle brushing with softer bristles at peripheral portions of the tooth brush head, that is to say especially where bristles of the tooth brush head can come into contact with the gum, to the extent these bristles are allowed to come into such contact with the gum. But such a known solution however provides a less effective brushing in depressions of the teeth, in the intermediate spaces between the teeth and in the gum pockets between the teeth and the gum, and the relatively rigid bristles in the middle portion of the tooth brush head will directly prevent and counteract that remaining bristles can penetrate within the plane of brushing which is limited by the rigid middle bristles.

According to the invention the objective is also to arrange the conditions better for brushing depressions of the teeth and intermediate spaces between the teeth together with the pockets between the teeth and the gum, at the same time as there is obtained an effective brushing of projecting edges of the teeth and relatively large surfaces of the teeth.

When different types of bristle groups with different rigidity are discussed herein, this is to be interpreted in the widest sense, that is to say on the one side bristle groups each with its respective type of clearly different bristles and on the other side bristle groups with different mixtures of different bristles. The different groups of bristles can generally also be considered as a collection of bristles with mutually different forms and with mutually different characteristics and if desired with considerable dimensional and material deviations within each group of bristles of the first and second types of bristle groups and with if desired equivalent deviations also within each bristle group of the third type of bristle groups and with clear deviations from type to type.

An important reason for being able to obtain better tooth brushing effects with tooth brushes according to the invention is for one thing that different densities and different geometries of bristles can be achieved in the middle region with the relatively short bristles than in the edge regions with the relatively long bristles. By this the relatively short and rigid bristle groups in the middle region of the tooth brush head can be utilised in a specific manner to effectively brush chewing surfaces of the teeth and upper edge portions of the teeth and simultaneously for the effective mutual support of neighbouring bristle groups. At the same time the relatively long and smaller rigid bristles can be utilised along peripheral portions of the tooth brush head, and the like in another specific manner for effectively brushing gum pockets, tooth intermediate spaces and similar tooth regions accessible generally with difficulty.

Due to bristle groups with mainly similar contours in the two mutually angled head portions being collected with great density especially in the middle portion of the tooth brush head, there is achieved surprisingly enough minimal mutual bracing in the lateral direction in said middle region, so that the bristles in the middle portion of the tooth brush head, in spite of everything, can be bent relatively unhindered in the lateral direction, the bristles of the two main collections of bristles crossing each other and being entangled inwardly between each other across the longitudinal direction of the tooth brush head. With a load obliquely towards the longitudinal direction of the bristles in the middle region of the tooth brush head, the mutually crossing bristles can be swung relatively unhindered inwardly between each other at the same time as the bristles are bent and thereby permit the remaining bristle groups with softer and longer bristles to be pushed further inwards into depressions, hollow spaces and pockets, as is intended.

At the same time the mutually crossing and mutually tangled bristles will shore each other up to a considerable degree longitudinally relative to the longitudinal direction of the tooth brush head. By means of the second type of bristle groups (that is to say bristle groups arranged sideways relative to the first type of bristle groups) especially the rigidity of the first and second bristle groups can collectively provide a local bracing and thereby an extra buttressing of the third (softer) bristle group. In this way the different bristle groups can be more easily bent in the intended manner laterally obliquely outwards than longitudinally obliquely outwards, relative to the surfaces which are to be brushed.

In the middle region of the tooth brush head there can be achieved by this an effective brushing by means of bristles which form abutments sideways against the brushing surfaces and by means of bristles which form abutments endways against the brushing surfaces—and then especially at chewing surfaces of the teeth with associated grooves and depressions—without preventing thereby that remaining bristle groups in the regions outside the middle region of the tooth brush head, are able to come into abutment against respective brushing surfaces. By employing bristle groups of mutually different rigidity and mutually different softness there can consequently be produced according to the invention additional different support longitudinally and sideways, but at the same time with great freedom to move in certain directions than in other directions and at the same time with greater resilience for the third (softer) bristle group and thereby a better brushing effect of the third bristle group. The afore-mentioned bracing and buttressing is favorable for the brushing effects, without thereby preventing the different bristles penetrating into tooth surface grooves, tooth depressions, tooth intermediate spaces and gum pockets. This freedom of movement of missing support in certain directions and greater support and less possibility of movement in remaining directions, is achieved partly by controlled rigidity of the different bristle groups and partly by the geometry of the bristle in each bristle group together with the special mutual geometry between the bristle groups of the mutually deviated head portions of the tooth brush head. Consequently one can, according to the invention, geometrically orientate the bristle groups relative to each other so that certain bristle groups which collide against each other within at the longitudinal middle plane of the tooth brush head, form a relatively tightly condensed group of mutually crossing, relatively short (and thereby relatively rigid) bristles, while remaining bristle groups which have greater length and generally less rigidity and which thereby have generally a greater possibility for movement, get their possibility for movement adjusted with locally arranged bristle groups which provide local bracing and support for the remaining bristle groups. Said bristle groups which are geometrically considered to provide great rigidity in certain directions can be made still more rigid by employing especially rigid bristle material, without preventing thereby the brushing effect of longer (and thereby relatively softer) neighbouring bristle groups disposed outside.

I claim:

1. A process for producing a toothbrush comprising the steps of providing a toothbrush blank having a central head portion and a pair of end head portions disposed in coplanar relation, a plurality of bristles extending from each head portion on one side of the blank and a plurality of grooves on an opposite side of the blank, each groove being disposed between said central head portion and an adjacent end head portion;

heating the blank in the region of the grooves while bending each end head portion relative to said central head portion in a direction to close the grooves;

thereafter cutting the bristles to form rows of bristles of different lengths; and thereafter heating the bent blank in the region of the grooves while bending each end head portion relative to said central head portion in a direction to open the grooves.

2. A process as set forth in claim 1 wherein heating of the blank is effected under flows of hot air applied to each side of the blank.

3. A process as set forth in claim 2 further comprising the steps of insulating the bristles from heat from the flow of hot air during said first step of heating the blank.

4. A process as set forth in claim 1 wherein each end head portion is bent on an axis near each respective groove and spaced from the central head portion.

5. A process as set forth in claim 2 wherein the bristles are cut along a common plane.

6. A process for producing a toothbrush comprising the steps of providing a toothbrush blank having a central head portion and a pair of end head portions disposed in coplanar relation, a plurality of bristles extending from each head portion on one side of the blank and a plurality of grooves on an opposite side of the blank, each groove being disposed between said central head portion and an adjacent end head portion; and heating the blank in the region of the grooves while bending each end head portion relative to said central head portion in a direction to open the grooves.

7. A process as set forth in claim 6 wherein heating of the blank is effected under flows of hot air applied to each side of the blank.

8. A process as set forth in claim 7 further comprising the step of insulating the bristles from heat from the flow of hot air during said step of heating the blank.

9. A process as set forth in claim 6 wherein each end head portion is bent on the axis near each respective groove and spaced from the central head portion.

10. A process as set forth in claim 6 which further comprises the step of cutting the bristles extending from the head portions on an arcuate section line prior to heating of said blank.

11. A process as set forth in claim 6 wherein the blank has a plurality of shallow cavities on said one side, each cavity being disposed opposite a respective groove to form a thin-walled section between each pair of head portions.

12. A process as set forth in claim 6 which further comprises the step of cutting the bristles on a concavely and convexly folded section line prior to heating of said blank.

13. A process for producing a toothbrush comprising the steps of providing a toothbrush blank having a plurality of heat portions, a plurality of bristles extending from each head portion on one side of the blank and a plurality of grooves on an opposite side of the blank, each groove being disposed between adjacent heat portions; and heating the blank in the region of the grooves while bending each head portion relative to an adjacent head portion in a direction to open the grooves.

14. A process as set forth in claim 13 which further comprises the steps of cutting the bristles to effect a decreasing height in a direction centrally of the blank.

* * * * *

UNITED STATES PATENT AND TRADEMARK OFFICE

CERTIFICATE OF CORRECTION

PATENT NO. : 5,114,214

DATED : May 19, 1992

INVENTOR(S) : Rolf Barman

It is certified that error appears in the above-identified patent and that said Letters Patent is hereby corrected as shown below:

Column 1, before line 5 insert the following:

--The present invention relates to a process for producing tooth brushes.--

Column 1, line 11 change "spaced" to -spaces-
Column 7, line 48 change "tent" to -bent-
Column 16, lines 6 and 10 change "heat" to -head- Signed and Sealed this Twentieth Day of July, 1993

*Attest:*

Michael K. Kirk

MICHAEL K. KIRK

*Attesting Officer*

*Acting Commissioner of Patents and Trademarks*